United States Patent [19]

Escallier

[11] Patent Number: 4,941,498

[45] Date of Patent: Jul. 17, 1990

[54] CRUTCH ATTACHMENT

[76] Inventor: Richard J. Escallier, 4854 W. Cullom, Chicago, Ill. 60641

[21] Appl. No.: 316,414

[22] Filed: Feb. 27, 1989

[51] Int. Cl.[5] ..... A61H 03/02

[52] U.S. Cl. ..... 135/68; 224/148; 224/273; 135/66; 248/309.1; 248/311.2

[58] Field of Search ..... 135/65, 68, 66; 248/309.1, 311.2; 224/273, 0.5, 148

[56] References Cited

U.S. PATENT DOCUMENTS

| | | | |
|---|---|---|---|
| 1,525,745 | 2/1925 | Keefer | 206/805 X |
| 2,553,730 | 5/1951 | Taylor | 135/47 |
| 3,429,541 | 2/2969 | Herman | 248/302 |
| 3,561,595 | 2/1971 | Weggeland | 206/805 X |
| 3,851,762 | 12/1974 | Liblick | 206/805 X |
| 3,930,578 | 1/1976 | Stein | 206/805 X |
| 3,985,148 | 12/1976 | Cadman | 135/66 |
| 4,089,412 | 5/1978 | Baugh | 206/314 |
| 4,146,045 | 3/1979 | Grant | 135/66 |
| 4,184,503 | 1/1980 | Nakajima | 135/68 |
| 4,262,800 | 4/1981 | Nethercutt | 206/805 X |
| 4,280,811 | 7/1981 | Howe, Jr. | 206/805 X |
| 4,428,390 | 1/1984 | Baird | 135/66 |
| 4,686,745 | 8/1987 | Butler | 24/17 |
| 4,721,125 | 1/1988 | Wang-Lee | 135/68 X |
| 4,733,682 | 3/1988 | Ellena | 135/68 X |
| 4,747,423 | 5/1988 | Hansen et al. | 135/68 |
| 4,830,238 | 5/1989 | Widinski et al. | 224/42.46 R |

FOREIGN PATENT DOCUMENTS

| | | | |
|---|---|---|---|
| 2615078 | 11/1988 | France | 224/148 |

*Primary Examiner*—David A. Scherbel
*Assistant Examiner*—Lan Mai
*Attorney, Agent, or Firm*—Mark W. Croll

[57] ABSTRACT

The invention comprises a crutch and carrier assembly including a crutch having a top and a bottom portion and a pair of parallel side rails between the top and the bottom portion, with the side rails being spaced apart at a predetermined distance, and a carrier assembly including an elastic annulus having a inner circumference in its unstretched state, with the inner circumference being less than twice the distance around the side rails. The annulus is positioned to grippingly encircle the side rails. In one embodiment the crutch and carrier assembly further comprises a plurality of elastic annuli, each grippingly encircling the side rails.

3 Claims, 2 Drawing Sheets

CRUTCH ATTACHMENT

BACKGROUND OF THE INVENTION

1. Field of the Invention

This invention relates to an improvement in crutches and crutch attachments to enable the user of the crutch to securely place various sized articles on the crutch and manipulate the crutch while not disturbing the articles. The invention also enhances the crutch's ability to act as a foot or leg support.

2. Description of the Prior Art

A person who needs to use a pair of crutches in order to ambulate generally must use both hands to maneuver the crutches. This does not allow him to have an entirely free hand to carry common, necessary articles, such as check books, pens, wallets and beverage cans. Some crutch users have tried to solve this problem by wearing back packs and satchels and the like with varying amounts of success.

Others have recognized the problem and various devices have been provided to assist a user of crutches in carrying objects. However, these prior devices have suffered from various drawbacks. For example, one package carrying crutch attachment of the prior art, as described in U.S. Pat. No. 2,553,730, which included an elastic means, also required a compartment with a complex folding trap door as well as hooks on the ends of the elastic straps. U.S. Pat. No. 4,146,045 describes a Crutch Carry-all Attachment, which has relatively rigid sides and outwardly opening grooves to engage the side rails of the crutch. Obviously, the size of articles that can be carried in this device is limited by the size of the device and thus, even common articles such as soda cans cannot be carried easily.

SUMMARY OF THE INVENTION

The present invention comprises a crutch and carrier assembly, known as a crutch pocket, comprising a crutch having a top and a bottom portion and a pair of spaced apart parallel side rails between the top and the bottom, and a carrier assembly including an elastic annulus encircling said side rails. The elastic annulus may preferably have a rest inner circumference of approximately between 6 and 8 inches and encircles the side rails in a stretched state.

The present invention also comprises a means for carrying articles on a crutch comprising an elastic annulus grippingly encircling the side rails of a crutch, where the crutch has a top and a bottom and a pair of side rails between the top and the bottom. The carrying means may comprise a plurality of elastic annuli each grippingly encircling the side rails.

The present invention also comprises a means for carrying articles on a crutch having a top and a bottom and a pair of spaced apart side rails between the top and the bottom, with the side rails being spaced apart at a predetermined distance. The carrying means includes an elastic annulus that has an inner circumference in its unstretched state of less than the distance around the side rails. The elastic annulus grippingly encircles the side rails.

In one embodiment the predetermined distance is approximately five inches.

The invention also comprises a crutch and carrier assembly including a crutch having a top and a bottom portion and a pair of side rails between the top and the bottom portion with the side rails having outer surfaces spaced apart at a predetermined distance, a carrier assembly including an elastic annulus having an inner circumference in its unstretched state, with the circumference being less than twice the distance around the outer surfaces of the side rails. The annulus is positioned so that it grippingly encircles the side rails.

In one embodiment, the crutch and carrier assembly further comprises a plurality of elastic annuli, each grippingly encircling the side rails.

It is an object of the invention to create a carrier assembly for attaching and carrying articles on a crutch by placing a plurality of stretched annuli around the side rails of the crutch.

It is contemplated that smaller articles can be placed between the side rails and kept in place by the annuli, or larger articles can be tucked underneath an annulus and hung off the side of the side rail.

It is a further object of the invention that these elastic annuli will act as a resilient leg support/foot rest if the one end of the crutch is leaned at an angle on a chair or ledge and the patient's leg is rested on top of the crutch.

The foregoing features and advantages of the invention, together with a more complete description of the invention, may be gained by referring to the following drawings and specifications, together with the appended claims.

DESCRIPTION OF THE PREFERRED EMBODIMENT

Figure 1:
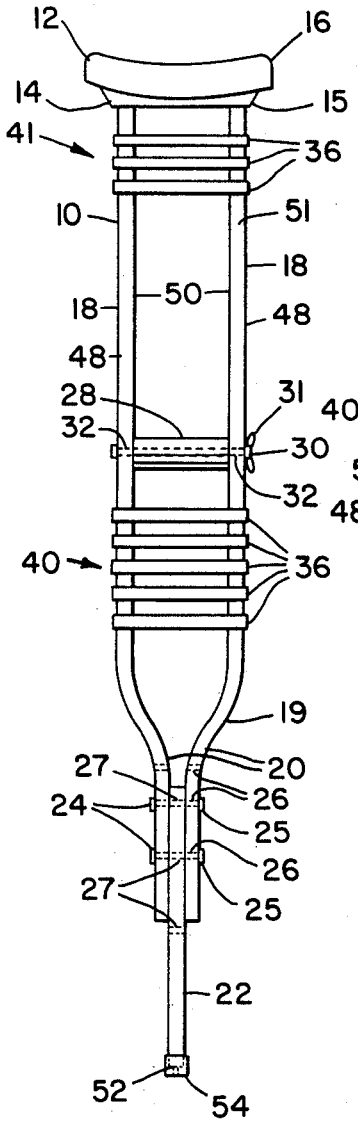
FIG. 1 is a side view of a crutch incorporating a crutch attachment device.

FIG. 1 shows a crutch 10 having a top portion 12 generally consisting of a top cross member 14 which is optionally covered by a padding 16 to cushion the under arm of the prospective user of the crutch.

Fixedly depending from the underside 15 of the top cross member 14 are a pair of side rails 18. The side rails are generally made of either hollow aluminum or solid wood and have a cross section of about 1 inch by $\frac{5}{8}$ inch. The side rails may also have more of a circular cross section of equivalent size. The shape and size are designed so that they have sufficient strength to hold the weight of a human using the crutches for ambulation.

The side rails 18 depend basically perpendicularly from the top cross member 14 and are parallel at about 6 to 8 inches apart for a majority of their length. In one preferred embodiment of a crutch, at their lower or bottom portions 20, the side rails are bent inwardly 19 until they are approximately one inch apart and then extend downwardly further on either side of a bottom leg 22.

Adjustably attached to the lower portion 20 of the side rails is the bottom leg 22. In one embodiment, a pair of bolts 24 runs through aligned holes 26 and 27 in the lower portions 20 of the side rails 18 and the leg 22. When the bolts are tightened by means of nuts 25, the bottom leg 22 is sandwiched between the two bottom portions 20 to make a structually rigid crutch. In this embodiment, the lower portions 20 of the side rails 18 and the leg 22 both have a plurality of equally spaced holes 26 and 27 so that the total height of the crutch bay be adjusted by selecting various pairs of holes 26 and 27 in which to insert the bolts 24. At the bottom tip 52 of leg 22 is preferably a grip 54 which aids in reducing the possibility that the crutch will slip on a walking surface.

In another prior art embodiment of a crutch, the lower portions 20 of the side rails 18 are affixed to a slender cylindrical sleeve having a plurality of apertures therein. The bottom leg 22 is placed in the sleeve and the total height of the crutch is adjustable by putting bolt 24 through the leg and the proper aperture of the sleeve. Examples are shown in U.S. Pat. No. 4,733,682 and U.S. Pat. No. 4,721,125.

Also attached to the side rails 18 and positioned between the side rails is an intermediate cross member or hand hold 28. The hand hold is positioned approximately equal distant from the top 12 of the crutch and the lower or bottom portion 20 of the side rails, but its position can be adjusted to fit the user of the crutch. It is attached to the side rails by a pair of bolts 30 and nuts 31, such as wing nuts, each one protruding thru co-axial apertures 32 in the side rails 18.

Figure 2:
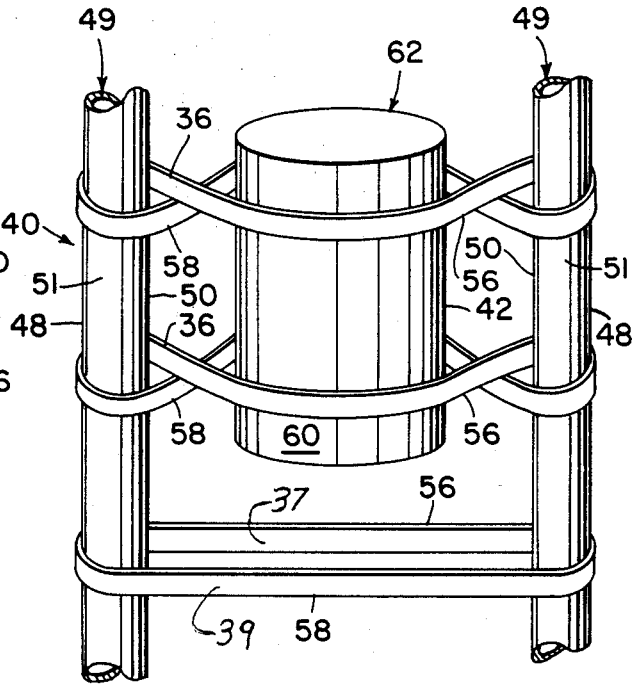
FIG. 2 is a side view in partial perspective of a crutch and crutch attachment device carrying an object.

The description of the crutch above is generally known in the prior art. For the instant invention, in addition to having sufficient strength for carrying the weight of a human, the side rails 18 must be sufficiently resistant to bending that they will not bow inwardly when elastic annuli 36 are stretched around them at various locations along their length. As can be seen in FIG. 2, each of the parallel side rails 18 has an outer surface 48 and an inner surface 50. Also, as viewed from one side, the side rails have a rear surface 49 and a front surface 51. The surfaces of the side rails must have sufficient roughness so that when an elastic annulus 36 is stretched around the rails, as shown in the Figures, the annulus will be able to grippingly adhere to the side rails and tend to stay in place.

The means for carrying articles on the crutch, or crutch attachment 34, consists of at least one and preferably a plurality of elastic annuli 36 positioned at various locations along the side rails 18 of the crutch. Each elastic annulus 36 has an inner 37 and an outer 39 surface (see FIG. 2) and is preferably made of a gummed rubber or similar elastic material and has a rest inner circumference, or distance around its inner surface, of less than the distance between side rails plus around the outer surfaces 38 of the side rails. Thus, when the annuli 36 are stretched around the side rails, they grippingly adhere to the side rails. The position of a given annulus can be altered by further stretching to disengage it from the side rail 18 and then longitudinal movement along the side rail.

As seen in the Figures, the annuli of one preferred embodiment have a width of approximately 3/16 to ⅜ of an inch. However, other elastic carrying means are also contemplated by the invention. For example, an elastic strap with a "velcro" brand fastener could be stretchingly wrapped around the side rails and the "velcro" brand fastener closed to create an annulus which would grippingly encircle the side rails and act as an attachment means.

Generally, the elastic annuli can be placed at any location along the side rails between the top cross member 14 and the lower or bottom portion 20. In a preferred embodiment, they are spaced apart along a 12 inch portion of the side rails to create a main carrying area 40 and a upper carrying area 41.

As can be seen in FIG. 2, the elastic annuli 36 can be manipulated to grippingly hold a cylinder 42, such as a common 12 oz can of beverage, with the annuli being placed in twisted arrangement in order to achieve sufficient tension on the cylinder for proper holding power. This twisting arrangement is achieved by the rear leg 56, or the leg stretched between the rear surfaces 49 of the side rails 18, being pulled forwardly to contact the front portion 60 of the side of the cylinder 42 the front leg 58, or the leg stretched between the front surfaces 51 of the side rails, being stretched to be in contact with the rear portion 62 of the cylinder 42.

In another preferred embodiment, the cylinder 42 is hollow and open at the top but closed at the bottom and has an inside diameter slightly greater than that of a typical 12 oz can and a height of slightly shorter than a 12 oz can. Thus, the cylinder 42 can be maintained between the stretched annuli 36 and a can can be easily inserted and removed from the cylinder 42 by the crutch user. In still a further embodiment, the cylinder may be hollow with a solid bottom and a replaceable cap on its top for holding small articles.

Figure 3:
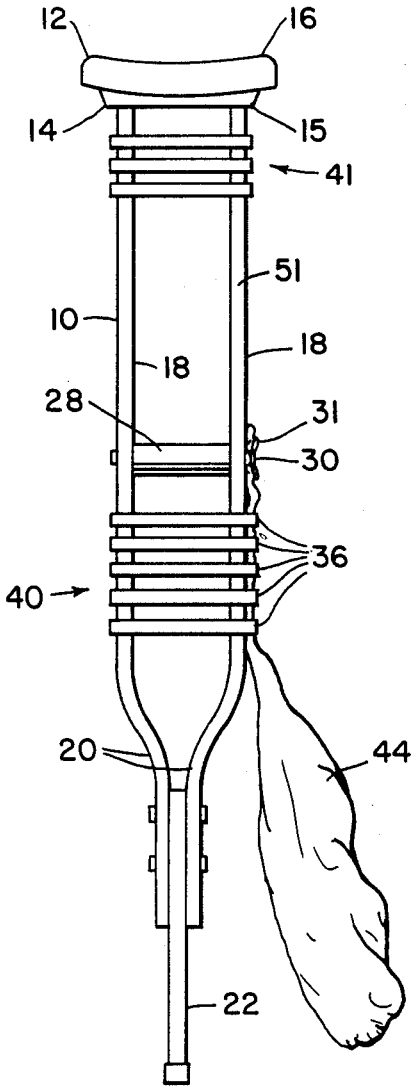
FIG. 3 is another side view of a crutch and crutch attachment device carrying a different type of object.

As can be seen in FIG. 3, a plurality of elastic annuli can be placed in a common locality and more bulky items can be carried in a bag 44 which has its top lip or handle hooked over bolt 30 and nut 31 and its top portion 46 wedged between one or more of the annuli 36 and one of the side rails 18. When the user of the crutches is manipulating the crutches in aided walking, the bag will rock from side to side and the user must learn to compensate for this rocking motion. A long, thin box, similar to a flower box has also been shown to be an effective container for articles, but easily carried either between or along side the side rails by being grippingly held by the elastic annuli 36.

Figure 4:
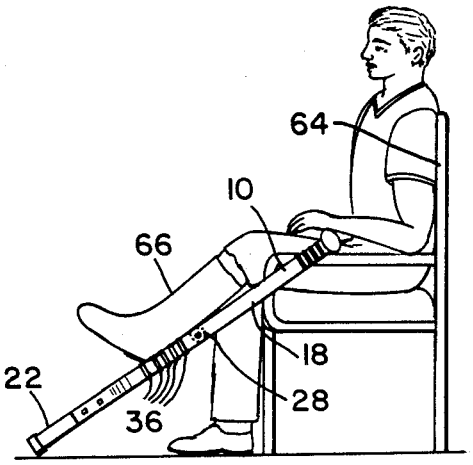
FIG. 4 is a perspective view of a crutch and crutch attachment device being used as a leg rest.

As seen in FIG. 4, the elastic annuli, when spaced approximately equidistantly along the crutch, can also act as a resilient cushioning device for the user's leg or cast 66 if the crutch 10 is leaned up against a chair or other ledge 64.

Additional annuli can be stored at the upper carrying area for possible use in other requirements, both as article carrying means as well as other nonrelated uses.

It can now be appreciated that articles of a vast variety of shapes and sizes and weights can be carried by the crutch attachment. While certain novel features of this invention have been shown and described and are pointed out in the annexed claims, it will be understood that various ommissions, substitutions and changes in the forms and details of the device illustrated and in its operation can be made by those skilled in the art without departing from the spirit and scope of the within invention.

I claim:

1. A crutch and carrier assembly for carrying an article on a crutch comprising, (A) a crutch having a top and a bottom portion and a pair of parallel side rails between said top and said bottom portion, said side rails having outer surfaces and being spaced apart at a predetermined distance, (B) a carrier including an elastic annulus having inner and outer surfaces and an inner circumference in its unstretched state, said circumference being less than twice said distance between said rails plus around said outer surfaces of said rails, (C) only said inner surface of said annulus grippingly encircling said side rails and only one of either said inner surface or said outer surface of said annulus grippingly engaging the article, and (D) the article being spaced from one of said side rails.

2. The means for carrying an article on a crutch of claim 1 further comprising a plurality of elastic annuli having inner surfaces, each inner surface grippingly encircling said side rails and grippingly engaging said article.

3. The means for carrying articles on a crutch of claim 2 wherein the predetermined distance is between 5 and 6 inches.

* * * * *